US007572198B2

(12) United States Patent
Bleecker

(10) Patent No.: US 7,572,198 B2
(45) Date of Patent: Aug. 11, 2009

(54) TRAINING GRIP FOR A BASEBALL BAT

(76) Inventor: Eugene J. Bleecker, 408 Mineola Blvd., Williston Park, NY (US) 11596

( * ) Notice: Subject to any disclaimer, the term of this patent is extended or adjusted under 35 U.S.C. 154(b) by 1 day.

(21) Appl. No.: 11/732,569

(22) Filed: Apr. 4, 2007

(65) Prior Publication Data

US 2007/0254753 A1 Nov. 1, 2007

Related U.S. Application Data

(60) Provisional application No. 60/796,833, filed on May 1, 2006.

(51) Int. Cl.
*A63B 59/06* (2006.01)

(52) U.S. Cl. ..... 473/568

(58) Field of Classification Search ..... 473/457, 473/519, 520, 564–568, 300–303, 551, 552
See application file for complete search history.

(56) References Cited

U.S. PATENT DOCUMENTS 2,091,458 A * 8/1937 Sleight ..... 16/421
4,848,746 A * 7/1989 Klink ..... 473/551
5,482,270 A * 1/1996 Smith ..... 473/568
5,577,722 A * 11/1996 Glassberg ..... 473/457
5,839,983 A * 11/1998 Kramer ..... 473/568
D444,193 S * 6/2001 Dodson ..... D21/725
6,305,051 B1 * 10/2001 Cho ..... 16/430
6,406,387 B1 * 6/2002 Ryan ..... 473/457
2004/0180739 A1 * 9/2004 Kramer ..... 473/568
2005/0202910 A1 * 9/2005 Blount ..... 473/568
2005/0272537 A1 * 12/2005 Kramer ..... 473/568

* cited by examiner

*Primary Examiner*—Mark S Graham
(74) *Attorney, Agent, or Firm*—Anthony J. Casella; Gerald E. Hespos

(57) ABSTRACT

A hand grip for training a batter such that both hands of the batter are properly positioned for impact with a baseball is provided. The bat grip includes a generally cylindrical member having an inner surface configured for receiving a lower portion of a bat, the member including an upper portion and a lower portion; the upper portion including a first plurality of finger grooves and a first protrusion disposed diametrically opposite the first plurality of finger grooves, the first protrusion configured to provide tactile information to a first hand of a batter; and the lower portion including a second plurality of finger grooves and a second protrusion disposed diametrically opposite the second plurality of finger grooves, the second protrusion configured to provide tactile information to a second hand of the batter, wherein the first protrusion is angularly offset from the second protrusion by a first predetermined angle.

19 Claims, 5 Drawing Sheets

TRAINING GRIP FOR A BASEBALL BAT

PRIORITY

This application claims priority to an application entitled "TRAINING GRIP FOR A BASEBALL BAT" filed in the United States Patent and Trademark Office on May 1, 2006 and assigned Ser. No. 60/796,833, the contents of which are hereby incorporated by reference.

BACKGROUND OF THE INVENTION

1. Field of the Invention

The subject invention relates to an improved hand grip for training a batter such that both hands of the batter are properly positioned for impact with a baseball. More particularly, the trainer baseball bat grip of the subject invention comprises a single elongated grip sized to receive both hands simultaneously to provide tactile sensations for knuckle alignment for each hand. The trainer baseball bat grip may be molded onto the handle end of a baseball bat or may be made of a hollow elastic material which may be slipped onto the end of the baseball bat. Furthermore, the trainer baseball bat grip may include two separate grip members which are interchangeable for left-handed and right-handed batters.

2. Description of the Prior Art

The game of baseball is typically played with either a wooden or an aluminum bat and is used to strike a baseball. The same applies in connection with the game of softball. The major baseball leagues only use wooden bats; however, college leagues and little league organizations generally employ aluminum bats. In order to increase gripping power, players have often worn gloves when gripping the handle end of a bat. Often, the wood or metal surface of a bat can be slippery, especially if the batter's hands are sweaty. Hence, many players use an additional sticky substance such as pine tar in conjunction with gloves to achieve a better grip on the bat. In like manner, because of their slick metal surface, aluminum softball bats usually come with adhesively attached tape that provides some form of grip, but is quickly worn and then no longer suitable as a gripping force. The factor of gripping the bat is very important in connection with the proper alignment of the hands of the batter in order to achieve proper and maximum power when the bat strikes the ball.

In addition to ensuring that the hands of a batter stay in position throughout the swing of a baseball bat, the batter must initially place their hands in proper alignment, e.g., alignment of the knuckles of the batter's hands. To ensure a level swing, the batter should align their hands properly and maintain the alignment throughout the swing. However, although initially aligned, the hands of a batter may become misaligned while the batter is shifting in the batter's box or from nervous movement of hands in anticipation of a pitch. This is especially true for Little Leaguers who may get easily distracted.

Therefore, a need exists for techniques to train a batter to properly align their hands when gripping a baseball bat. A further need exists for techniques to train a batter to maintain alignment of their hands during a swing of the bat at a pitched baseball.

SUMMARY OF THE INVENTION

The present invention overcomes the shortcomings of the prior art by providing for a uniquely designed trainer bat grip that includes upper and lower segments or members. The training grip of the subject invention includes finger grooves and protrusions which facilitate proper wrist roll, better holding power, and ensures proper knuckle alignment of both hands of the batter.

In one embodiment of the subject invention, the trainer bat grip may be constructed of a single elongated vinyl, rubber or neoprene, tubular-like member that is sized to fit snugly around the lower stock portion of the bat and with the grip length being sized to receive both hands simultaneously. The single elongated trainer bat grip is sized for both hands at the same time and includes two raised dome surface segments or protrusions that give tactile information to the hands for proper knuckle alignment, as well as a plurality of finger grooves, with enough grooves to accommodate both hands simultaneously on the single grip. The combination of the raised domes and finger grooves allow for proper knuckle alignment.

Another embodiment of the subject invention consists of the single elongated grip for both hands simultaneously and includes an elongated, longitudinally extending slot or slit which allows the grip body member to be resiliently spread apart to permit attachment over the handle portion of the bat. Furthermore, the grip may include adhesive tape for wrapping all or portions of the single grip to hold the slit together flush once the grip has been positioned on the bat.

The subject grip may be installed at the factory and/or as an after-market product by sliding it over the end of the bat or, with the slotted embodiment, attached to an existing bat secured with a continuous spiral of tape or adhesive. Either embodiment of the subject invention can be constructed and sized so that it is capable of being attached to an existing bat or the improved trainer grip could be installed at the factory.

According to one aspect of the present disclosure, a bat grip is provided including a generally cylindrical member having an inner surface configured for receiving a lower portion of a bat, the member including an upper portion and a lower portion; the upper portion including a first plurality of finger grooves and a first protrusion disposed diametrically opposite the first plurality of finger grooves, the first protrusion configured to provide tactile information to a first hand of a batter; and the lower portion including a second plurality of finger, grooves and a second protrusion disposed diametrically opposite the second plurality of finger grooves, the second protrusion configured to provide tactile information to a second hand of the batter, wherein the first protrusion is angularly offset from the second protrusion by a first predetermined angle. The tactile information aligns knuckles of the first hand of the batter to the knuckles of the second hand of the batter. The cylindrical member, the first and second plurality of finger grooves and the first and second protrusions are of a unitary construction.

In another aspect, the first predetermined angle is in the range of about 10 degrees to about 30 degrees and preferably is in the range of about 20 degrees.

In another aspect, the first plurality of finger grooves is angularly offset from the second plurality of finger grooves by a second predetermined angle. The second predetermined angle is in the range of about 10 degrees to about 20 degrees and preferably is in the range of about 15 degrees.

In a further aspect, the cylindrical member includes a longitudinally extending slit configured for disposing the grip about a lower portion of a bat.

According to another aspect of the present invention, a bat grip includes a first generally cylindrical member having an inner surface configured for receiving a lower portion of a bat, the first member including a first plurality of finger grooves and a first protrusion disposed diametrically opposite the first plurality of finger grooves, the first protrusion configured to provide tactile information to a first hand of a batter; and a second generally cylindrical member having an inner surface configured for receiving a lower portion of a bat, the second member including a second plurality of finger grooves and a second protrusion disposed diametrically opposite the second plurality of finger grooves, the second protrusion configured to provide tactile information to a second hand of a batter, wherein the first and second members are disposed on the lower portion of the bat so the first protrusion is angularly offset from the second protrusion by a first predetermined angle.

In yet another aspect, each of the first and second grip members include defined edges configured for aligning the first and second grip members. For example, each of the first and second members include a finger extending from an upper portion and a notch formed in a lower portion, wherein when the finger and notch are matched the first protrusion is angularly offset from the second protrusion by the first predetermined angle. The first and second members may be reversibly disposed on the-lower portion of the bat.

BRIEF DESCRIPTION OF THE DRAWINGS

The above and other aspects, features, and advantages of the present disclosure will become more apparent in light of the following detailed description when taken in conjunction with the accompanying drawings in which.

DESCRIPTION OF THE PREFERRED EMBODIMENTS

Preferred embodiments of the present disclosure will be described hereinbelow with reference to the accompanying drawings. In the following description, well-known functions or constructions are not described in detail to avoid obscuring the present disclosure in unnecessary detail.

The baseball bat trainer grip of the subject invention is composed of a material such as vinyl, rubber or neoprene that creates good frictional contact between the epidermis of a player's hands, the grip and the outer surface of the baseball bat segment. In a first embodiment of the subject invention, the unitary tubular segment defining the trainer grip includes a plurality of finger grooves with enough grooves to accommodate both hands simultaneously on the single grip. The grooves for each hand are in alignment, however, the grooves for the left hand are disposed at an angle to the grooves for the right hand. Disposed on the opposite side of the finger grips for the left hand and right hand of the batter are protrusions in the form of dome-shaped exterior surfaces that give tactile information to the hands to advise where the knuckles should be relative to the grip for proper knuckle alignment. With the knuckles of both hands being in alignment, the trainer grip ensures that the batter has proper wrist roll and better holding power of the bat.

In an alternative embodiment, the tubular trainer grip includes a longitudinally extending slit which enables the trainer grip to be separated and placed over the handle portion of the baseball bat, after which tape may be applied to the outer surface of the trainer grip to maintain it in place. Alternatively, the trainer grip may be adhesively bonded to the handle of the baseball bat.

In a further embodiment, the trainer grip will be composed of two separate grip elements or members, each grip member individually positionable on the bat. Each independent grip member includes defined edged to properly align the grip members for either a left-handed or right-handed batter.

Figure 1:
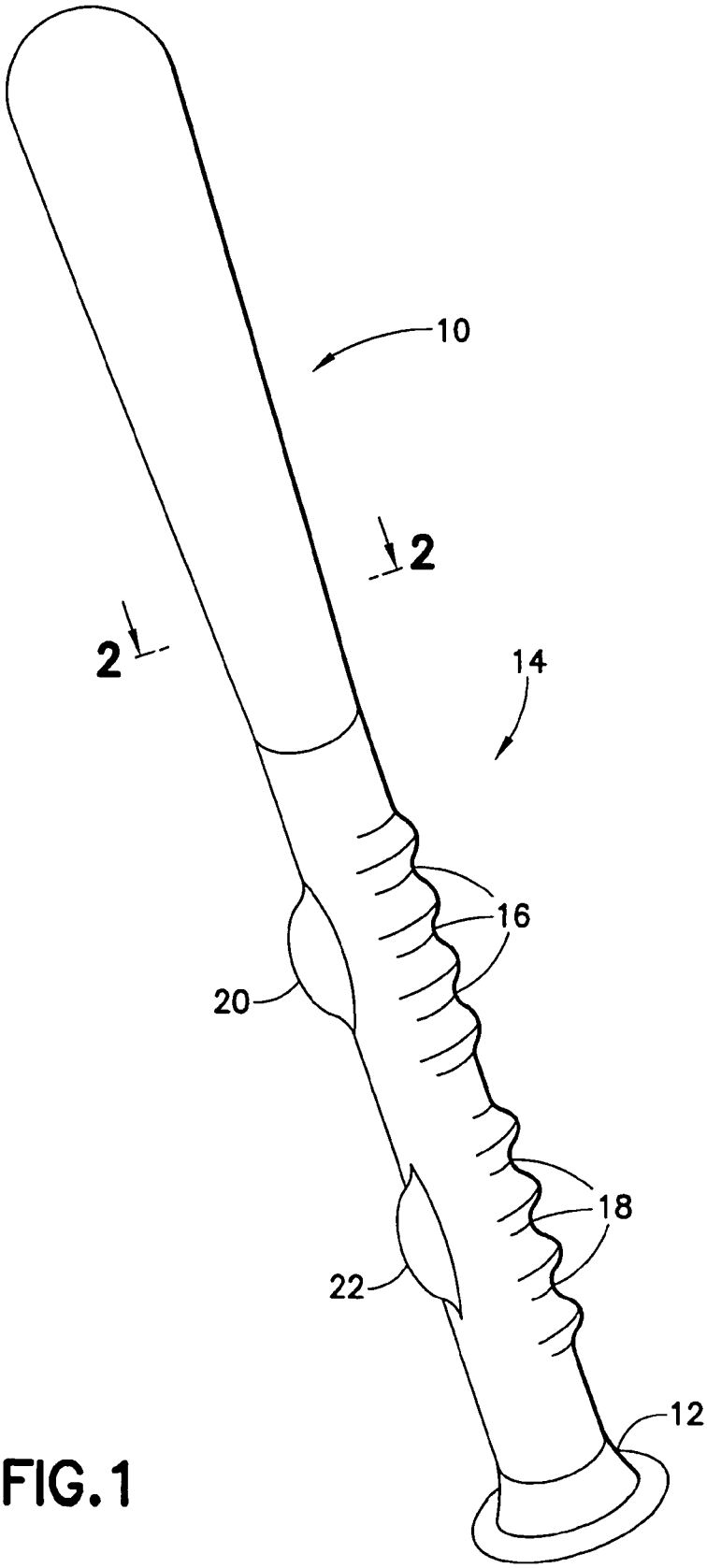
FIG. 1 is a perspective view of the trainer bat grip according to an embodiment of the present disclosure as attached to a baseball bat.
Figure 2:
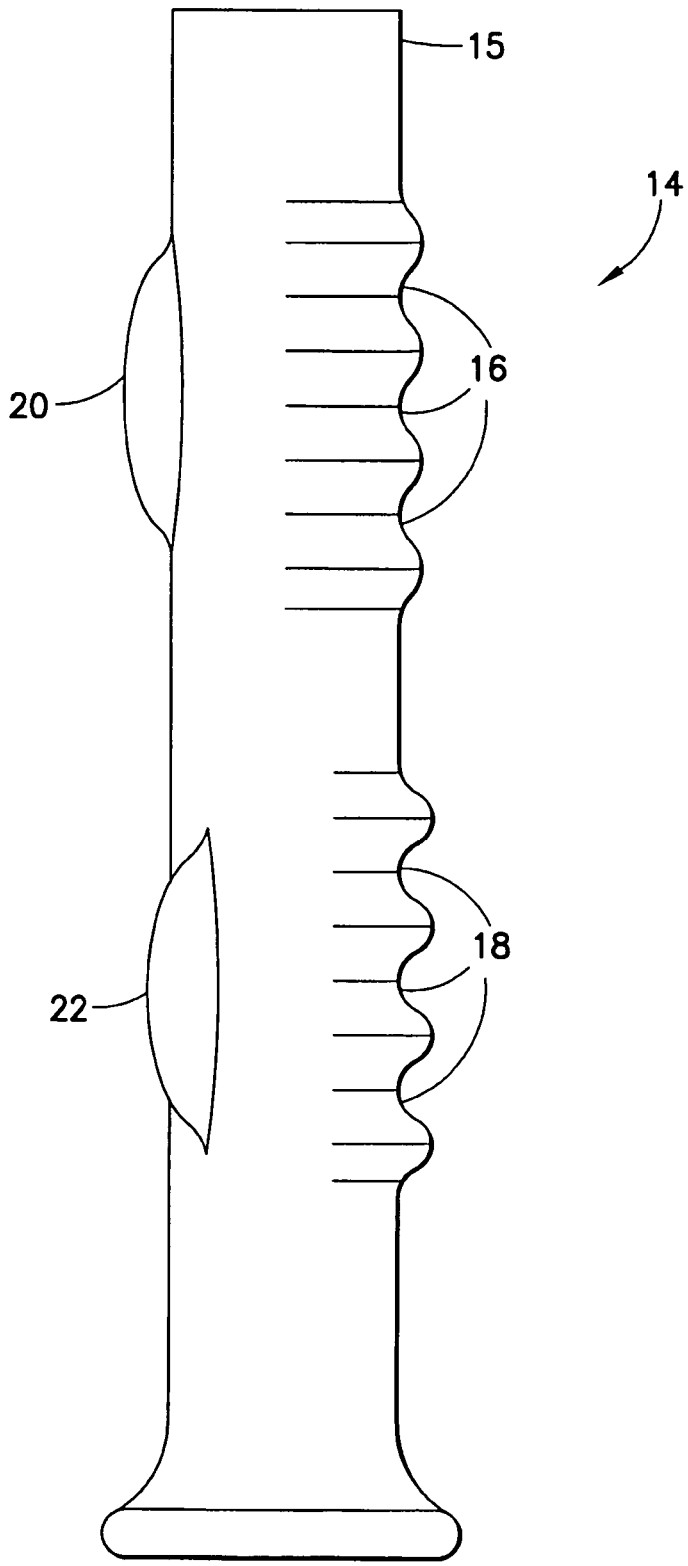
FIG. 2 is a side view of the trainer bat grip shown in FIG. 1.

Turning to FIGS. 1 and 2, baseball bat 10 includes a lower stock grip handle portion 12 to which is attached the trainer grip 14 of the subject invention.

The trainer grip 14 is composed of a single, unitary and generally cylindrical member 15 made of vinyl, rubber or neoprene and includes two sets of three finger grooves, designated by the numerals 16 and 18 respectively. Each set of finger grooves 16, 18 is designed to comfortably accommodate the four digital fingers of the batter's hand.

Disposed on the diametrically opposite sides of the finger grooves 16 and 18 are dome-shaped surface segments 20 and 22, respectively. Each dome-shaped surface segment 20, 22 is designed to fit comfortably within the respective palm of the batter. Accordingly, the combination of the finger grooves 16, 18 and the dome-shaped-surface segments 20, 22 provide tactile information to the hands for proper knuckle alignment which facilitates proper wrist roll during swinging of the bat, better holding power of the batter to the bat, and ensures proper knuckle alignment of both hands of the batter.

Figure 3:
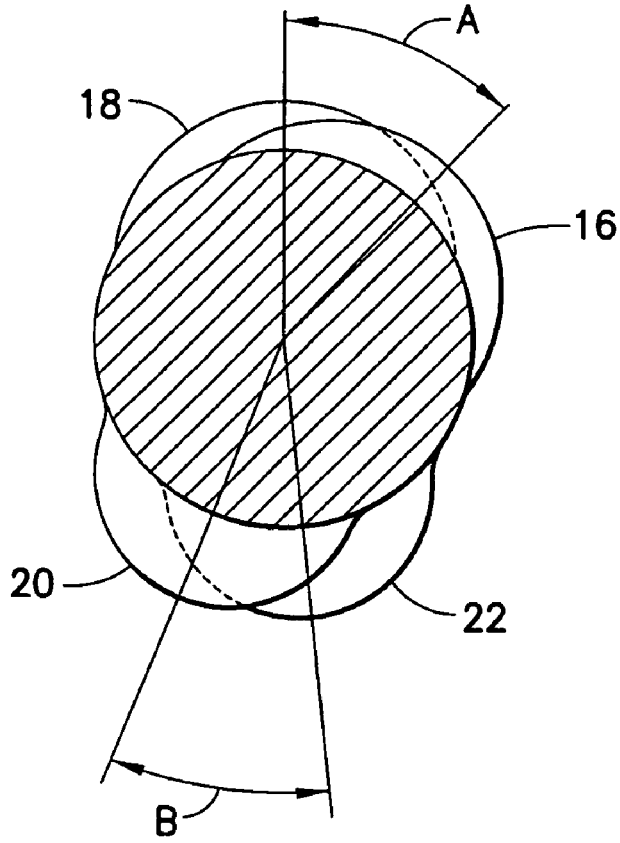
FIG. 3 is a cross-sectional view taken along line 2-2 in FIG. 1.

FIG. 3 illustrates the geometric relationship between the finger grooves 16, 18 and the dome-shaped surface segments 20, 22. As illustrated in FIG. 3, the series of finger grooves 16 are angularly offset in a radial direction from the finger grooves 18 by an angle designated by the letter "A". Angle "A" is in the range of 10 degrees to 20 degrees, and preferably 15 degrees.

Similarly, the dome-shaped surface segment 22 is angularly radially offset from the dome-shaped surface segment 20 by an angle designated by the letter "B". Angle "B" is in the range of 10 degrees to 30 degrees, and preferably 20 degrees.

As noted above, the trainer grip 14 of the subject invention may be molded onto the lower stock portion 12 of the bat at the factory. Alternatively, the trainer grip may be constructed from a flexible material wherein the trainer grip may be stretched and slid over a knob of the bat.

Figure 4A:
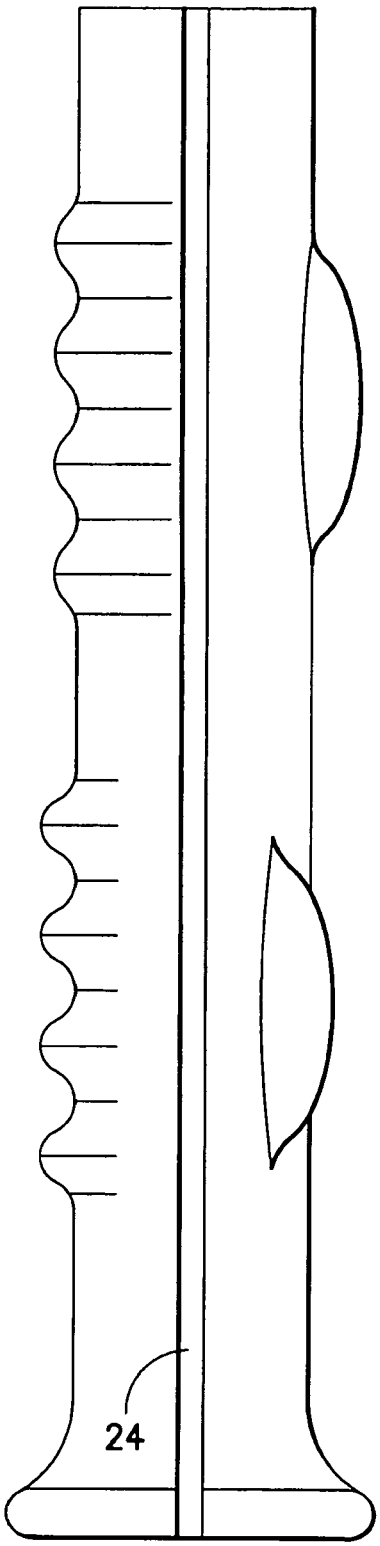
FIG. 4A is a side view of a trainer bat grip according to another embodiment of the present disclosure.
Figure 4B:
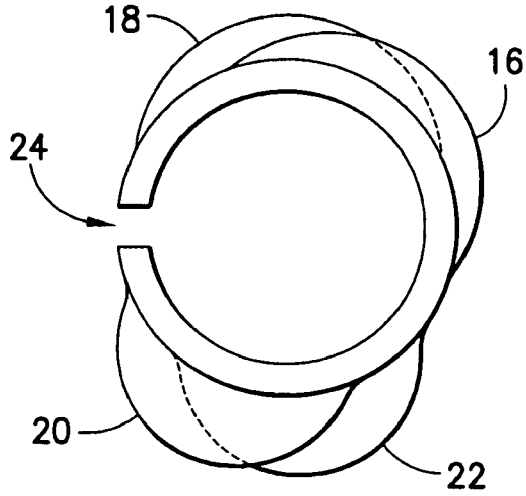
FIG. 4B is a top view of the trainer bat grip shown in FIG. 4A.

Referring to FIGS. 4A and 4B, the trainer grip 14 may be made of hollow construction, with a longitudinally extending slit 24, such that the trainer grip may be fit snugly over the lower portion 12 of the bat, and secured thereto by tape or by a suitable adhesive. In this embodiment, the trainer grip 14 consists of the single elongated grip for both hands simultaneously and includes an elongated, longitudinally extending slot or slit 24 which allows the grip body member to be resiliently spread apart to permit attachment over the handle portion of the bat. Furthermore, the grip may include adhesive tape for wrapping all or portions of the single grip to hold the slit together flush once the grip has been positioned on the bat.

Figure 5:
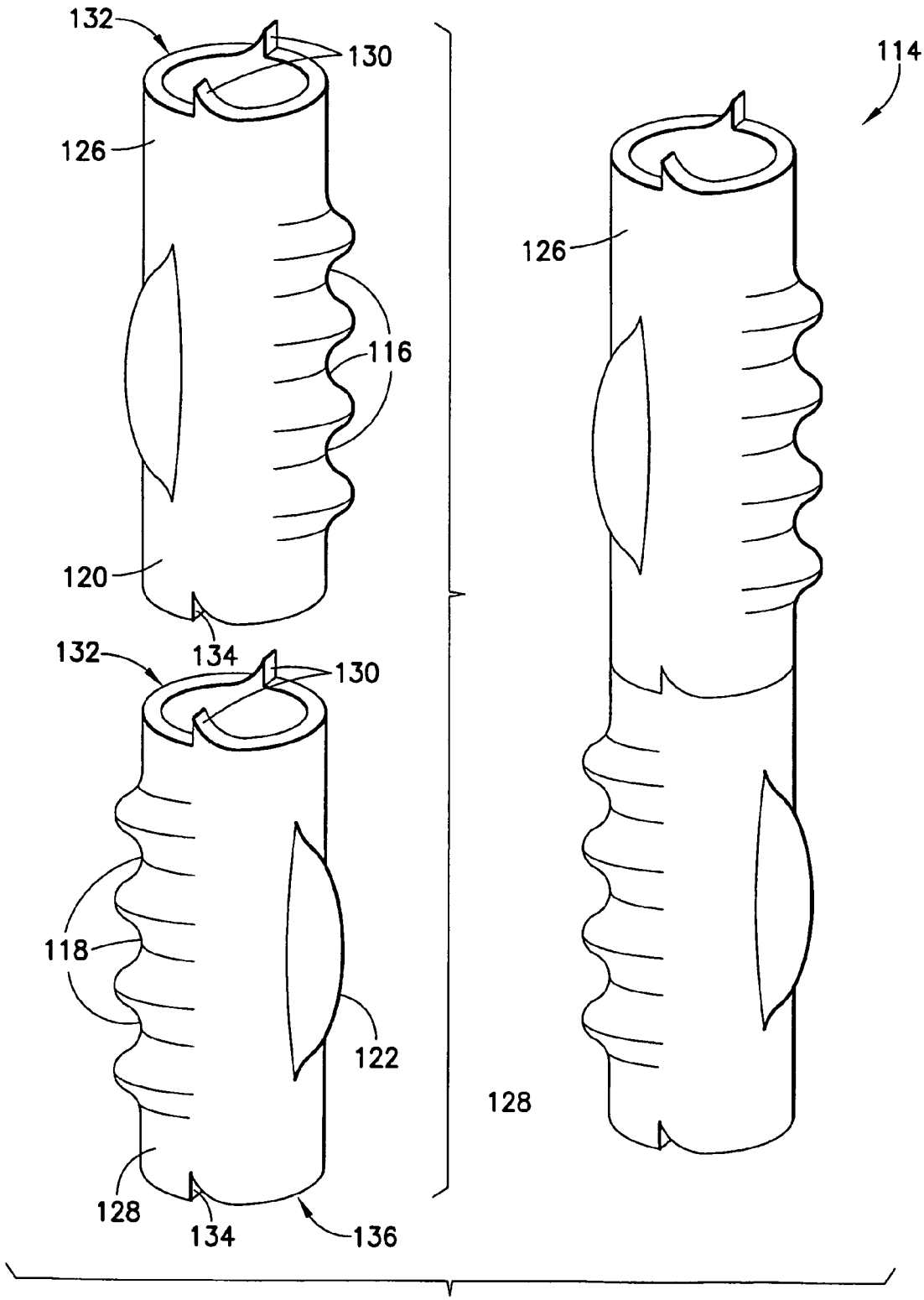
FIG. 5 is a side view of a further embodiment of the trainer bat grip of the present disclosure shown in exploded and assembled forms.

Referring to FIG. 5, a further embodiment of the trainer grip 114 is illustrated. In this embodiment, the trainer grip 114 includes two separate and individually positionable grip members 126, 128. The first member 126 includes at least three fingers grips 116 and a protrusion 120 similar to the upper portion of the trainer grip 14 described above. The second member 128 includes at least three fingers grips 116 and a protrusion 122 similar to the lower portion of the trainer grip 14 described above. Each of the first and second members 126, 128 include defined edges to properly align the grip members 126, 128. For example, each of the first and second members 126, 128 may include a finger 130 extending from an upper portion 132 of the grip member 126, 128 and a notch 134 formed in a lower portion 136 of each grip member 126, 128. When each member 126, 128 are disposed over a lower portion of a bat, each grip member 126, 128 will be rotated so the finger 130 and notch 134 are matched and the first protrusion 120 is angularly offset from the second protrusion 122 by the predetermined angle "B", wherein angle "B" is in the range of 10 degrees to 30 degrees, and preferably 20 degrees. In this manner, the grip members 126, 128 can be mated to from a single grip.

Furthermore, the first and second grip members 126, 128 can be reversibly disposed on the lower portion of the bat to accommodate right-handed or left-handed batters. In FIG. 5, the assembled grip is suitable for a left-handed batter. When the trainer grip 114 is to be used by a right-handed batter, the second grip member 128 will placed on the bat first, i.e., to be the upper portion, and the first grip member 126 will be placed on the bat below and in contact with the second member 128. Since each grip member has the finger 130 and notch 134, the first and second grip members 126, 128 will also be in proper alignment regardless of the position each grip member is placed on the bat. It is to be appreciated that the individual grip members 126, 128 can be composed of a flexible or elastic material allowing the grip member to be slid on an end of the bat or may include a slit or slot as described above to facilitate the placement of the grip members on the handle of the bat.

An advantage of the trainer grip of the subject invention is to properly position the hands of the batter for enhanced wrist roll. Another advantage of using the trainer, grip of the subject invention is that it greatly increases a person's grip on the bat without having to use pine tar or batting gloves. Still further, the trainer grip of the subject invention, being made of a resilient material, reduces hand stinging by absorbing some of the shock that may be obtained from hitting the ball. It can also reduce vibration and even blistering on the hands from using the bat. Still further, the trainer grip of the subject invention allows for a firmer grip, especially in cold weather. Most importantly, the trainer grip aids in training the batter as to the correct positions of the hands so that, later, using a conventional bat, the batter grips the bat in a proper manner.

The subject invention has been described and shown herein in what is considered to be a practical and preferred embodiment. It is recognized, however, that departures may be made therefrom within the scope of the invention and that obvious modifications will occur to a person skilled in the art.

What is claimed is:

1. A bat grip comprising:

a generally cylindrical member having an inner surface configured for receiving a lower portion of a bat, the member including an upper portion and a lower portion;

the upper portion including a first plurality of finger grooves and a first dome-shaped protrusion disposed diametrically opposite the first plurality of finger grooves, the first dome-shaped protrusion adapted to be received in a palm of a first hand of a batter and to provide tactile information to the first hand of the batter; and the lower portion including a second plurality of finger grooves and a second dome-shaped protrusion disposed diametrically opposite the second plurality of finger grooves, the second dome-shaped protrusion adapted to be received in a palm of a second hand of the batter and to provide tactile information to the second hand of the batter, wherein the first dome-shaped protrusion is radially angularly offset from the second dome-shaped protrusion by a first predetermined acute angle and the tactile information aligns knuckles of the first hand of the batter to the knuckles of the second hand of the batter.

2. The bat grip as in claim 1, wherein the first predetermined acute angle is in the range of about 10 degrees to about 30 degrees.

3. The bat grip as in claim 1, wherein the first predetermined acute angle is in the range of about 20 degrees.

4. The bat grip as in claim 1, wherein the first plurality of finger grooves is angularly offset from the second plurality of finger grooves by a second predetermined angle.

5. The bat grip as in claim 4, wherein the second predetermined angle is in the range of about 10 degrees to about 20 degrees.

6. The bat grip as in claim 4, wherein the second predetermined angle is in the range of about 15 degrees.

7. The bat grip as in claim 1, wherein the cylindrical member includes a longitudinally extending slit configured for disposing the grip about a lower portion of a bat.

8. The bat grip as in claim 1, wherein the cylindrical member, the first and second plurality of finger grooves and the first and second protrusions are of a unitary construction.

9. A bat grip comprising:

a generally cylindrical member having an inner surface configured for receiving a lower portion of a bat, the member including an upper portion and a lower portion;

the upper portion including a first plurality of finger grooves and a first dome-shaped protrusion disposed diametrically opposite the first plurality of finger grooves, the first dome-shaped protrusion adapted to be received in a palm of a first hand of a batter and to provide tactile information to the first hand of the batter; and the lower portion including a second plurality of finger grooves and a second dome-shaped protrusion disposed diametrically opposite the second plurality of finger grooves, the second dome-shaped protrusion adapted to be received in a palm of a second hand of the batter and to provide tactile information to the second hand of the batter, wherein the tactile information aligns knuckles of the first hand of the batter to the knuckles of the second hand of the batter, wherein the first dome-shaped protrusion is radially angularly offset from the second dome-shaped protrusion by a first predetermined angle and the first predetermined angle is in the range of about 10 degrees to about 30 degrees and wherein the first plurality of finger grooves is angularly offset from the second plurality of finger grooves by a second predetermined angle and the second predetermined angle is in the range of about 10 degrees to about 20 degrees.

10. A bat grip comprising:

a first generally cylindrical member having an inner surface configured for receiving a lower portion of a bat, the first member including a first plurality of finger grooves and a first dome-shaped protrusion disposed diametrically opposite the first plurality of finger grooves, the first dome-shaped protrusion adapted to be received in a palm of a first hand of a batter and to provide tactile information to the first hand of the batter; and a second generally cylindrical member having an inner surface configured for receiving a lower portion of a bat, the second member including a second plurality of finger grooves and a second dome-shaped protrusion disposed diametrically opposite the second plurality of finger grooves, the second dome-shaped protrusion adapted to be received in a palm of a second hand of the batter and to provide tactile information to the second hand of the batter, wherein the tactile information aligns knuckles of the first hand of the batter to the knuckles of the second hand of the batter, wherein the first and second members are disposed on the lower portion of the bat so the first protrusion is radially angularly offset from the second protrusion by a first predetermined acute angle.

11. The bat grip as in claim 10, wherein each of the first and second grip members include defined edges configured for aligning the first and second grip members.

12. The bat grip as in claim 10, further comprising at least two fingers axially extending from an upper portion of the second cylindrical member and at least two corresponding notches axially formed in a lower portion of the first member for receiving the at least two fingers of the second member and properly aligning the first and second members.

13. The bat grip as in claim 10, wherein each of the first and second cylindrical members include at least one finger axially extending from an edge of an upper portion and at least one notch formed in an edge of a lower portion, wherein when the at least one finger and the at least one notch mate the first protrusion is angularly offset from the second protrusion and fixed at the first predetermined acute angle.

14. The bat grip as in claim 13, wherein the first and second members are reversibly disposed on the lower portion of the bat.

15. The bat grip as in claim 10, wherein the first predetermined acute angle is in the range of about 10 degrees to about 30 degrees.

16. The bat grip as in claim 10, wherein the first predetermined acute angle is in the range of about 20 degrees.

17. The bat grip as in claim 10, wherein the first plurality of finger grooves is angularly offset from the second plurality of finger grooves by a second predetermined angle.

18. The bat grip as in claim 10, wherein the second predetermined angle is in the range of about 10 degrees to about 20 degrees.

19. The bat grip as in claim 10, wherein each of the first and second grip members include a longitudinally extending slit configured for disposing the grip member about a lower portion of a bat.

* * * * *